US010214017B2

(12) United States Patent
Geissler et al.

(10) Patent No.: US 10,214,017 B2
(45) Date of Patent: Feb. 26, 2019

(54) METHOD FOR DETECTING AND COMPENSATING FOR FAILED PRINTING NOZZLES IN AN INKJET PRINTING MACHINE

(71) Applicant: HEIDELBERGER DRUCKMASCHINEN AG, Heidelberg (DE)

(72) Inventors: Wolfgang Geissler, Bad Schoenbrn (DE); Martin Mayer, Ladenburg (DE); Frank Muth, Karlsruhe (DE); Hans Koehler, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/836,962

(22) Filed: Dec. 11, 2017

(65) Prior Publication Data

US 2018/0162134 A1 Jun. 14, 2018

(30) Foreign Application Priority Data

Dec. 14, 2016 (DE) ..... 10 2016 224 971

(51) Int. Cl.
*B41J 2/165* (2006.01)
*B41J 2/21* (2006.01)
*B41J 25/00* (2006.01)

(52) U.S. Cl.
CPC ..... *B41J 2/16579* (2013.01); *B41J 2/2139* (2013.01); *B41J 2/2142* (2013.01); *B41J 2/2146* (2013.01); *B41J 2025/008* (2013.01)

(58) Field of Classification Search
CPC .... B41J 2/16579; B41J 2/2139; B41J 2/2142; B41J 2/2146
See application file for complete search history.

(56) References Cited

U.S. PATENT DOCUMENTS 9,224,080 B2 * 12/2015 Kubota ..... G01N 21/278
9,561,644 B1 * 2/2017 Clark ..... B41J 2/2142
2012/0050377 A1 3/2012 Ueshima

* cited by examiner

*Primary Examiner* — Lamson Nguyen
(74) *Attorney, Agent, or Firm* — Laurence A. Greenberg; Werner H. Stemer; Ralph E. Locher

(57) ABSTRACT

A method for detecting and compensating for failed printing nozzles in an inkjet printing machine by using a computer, includes printing a current print image, recording the printed print image by using an image sensor and digitizing the recorded print image by using the computer, adding digitized color values of the recorded print image of every column over the entire print image height and dividing the added-up color values by the number of pixels to obtain a column profile, subtracting an optimized column profile without failed printing nozzles from the original column profile to obtain a differential column profile, setting a maximum value threshold defining a failed printing nozzle when exceeded, applying that maximum value threshold to the differential column profile to obtain a resultant column profile every maximum of which marks a failed printing nozzle. The marked printing nozzles are compensated in a subsequent printing operation.

11 Claims, 6 Drawing Sheets

METHOD FOR DETECTING AND COMPENSATING FOR FAILED PRINTING NOZZLES IN AN INKJET PRINTING MACHINE

CROSS-REFERENCE TO RELATED APPLICATION

This application claims the benefit, under 35 U.S.C. § 119, of German Patent Application DE 10 2016 224 971.1, filed Dec. 14, 2016; the prior application is herewith incorporated by reference in its entirety.

BACKGROUND OF THE INVENTION

Field of the Invention

The present invention relates to a method for detecting and compensating for failed printing nozzles in an inkjet printing machine by using a computer.

The technical field of the invention is the field of digital printing.

There are various technical implementation approaches in the field of digital printing. One of the most common approaches is so-called inkjet printing. Inkjet printing machines which are used for that process include one or more print heads, which are in turn provided with a plurality of individual printing nozzles for applying the ink to be used to the printing material to be used. In that process, every print head usually uses inks of a specific process color. A widespread problem with that type of technology is that individual printing nozzles may fail or be only partly functional. That may, for instance, be due to a blocking of individual printing nozzles, allowing the printing nozzle in question to only emit a part of the originally envisaged amount of ink and causing it to emit that part of the ink in an undesired direction, or, in an extreme case, to emit no ink at all. Since cleaning such blockages is extremely complex and since a failure of an individual printing nozzle may not necessarily be caused by a blockage, it is mandatory to detect failed nozzles, also referred to as missing nozzles, and to compensate for the failure with minimum effort and to an extent that minimizes the effect on the desired quality of the print.

There are various prior art approaches to detecting missing nozzles. The most common approach certainly is to print so-called nozzle check patterns, the preferably automated evaluation of which leads to an unerring detection and localization of their position in the print head.

That is usually done by using inline digital cameras that record the printed image as an RGB image immediately downstream of the print heads in the machine and analyze the recorded image to find the locations of missing nozzles. That process involves three major difficulties in detecting the missing nozzles:

1. Inline cameras are unable to represent the high resolution of 1200 dpi and more that is common in high-quality digital printing or are only able to do so at very high cost.
2. The recording optical camera system deviates from the exact recording geometry and its scale both in global and in local terms.
3. In the actual image, the (4-7) colors are printed on top of one another.

That results in two problems: all three aspects cause the missing nozzles in the RGB image of the camera to be represented at a much reduced contrast and may thus get lost in the image and camera noise. Furthermore, it is very difficult to establish an unequivocal correlation between camera pixel and printing nozzle.

For those two reasons, today's prior art relies on specific nozzle check patterns in which equidistant vertically printed lines are periodically printed in a horizontal row. In that horizontal row, only every $x^{th}$ printing nozzle, for instance every tenth printing nozzle, is used to print such a vertical line. Now, for instance, if in a horizontal line every tenth printing nozzle prints, starting at the first and moving on to the eleventh etc., the entire nozzle check pattern logically needs to include ten horizontal rows to include all printing nozzles present in the print head. In every following horizontal row, the respective next printing nozzle, in the given example the second, twelfth, etc. printing nozzle, will print the vertical line. The result is a nozzle check pattern formed of ten horizontal rows, for instance, in which every printing nozzle of the print head has printed at least one vertical line. A recording of that print nozzle check pattern by using a camera and a subsequent evaluation of the individual vertical lines allows failed or partly failed printing nozzles that spray at an angle to be reliably detected and localized even at lower camera resolutions.

A disadvantage of that method is, however, that even small printing nozzle positioning deviations in a micrometer range may cause defects in solid areas that are below the detection threshold of the method. In addition, an evaluation using smaller tolerances, which would be necessary to detect the aforementioned small deviations, results in false positive signals for intact nozzles, causing unnecessary corrections, significantly complicating the correction process, and having negative effects on the printed image.

SUMMARY OF THE INVENTION

It is accordingly an object of the invention to provide a method for detecting and compensating for failed printing nozzles in an inkjet printing machine, which overcomes the hereinafore-mentioned disadvantages of the heretofore-known methods of this general type and which provides a further way of detecting missing nozzles and using this knowledge for compensation purposes in order to enhance or replace the known methods.

With the foregoing and other objects in view there is provided, in accordance with the invention, a method for detecting and compensating for failed printing nozzles in an inkjet printing machine by using a computer, the method comprising the steps of printing a current print image, recording the printed print image by using an image sensor and digitizing the recorded print image by using the computer, adding digitized color values of the recorded print image of every column over the entire print image height and dividing the added color values by the number of pixels to obtain a column profile, subtracting a pre-created column profile of a defect-free reference image of the same print image from the original column profile to calculate a difference column profile, setting a maximum value threshold that defines a failed printing nozzle when exceeded, applying that maximum value threshold to the differential column profile to obtain a column profile in which every maximum thereof marks a failed printing nozzle, and compensating for the marked printing nozzles in a subsequent printing operation.

For this method, the column averages for the color values of the redigitized print image of the digital camera are generated over the entire print image width. In this process the entire image or only an image part is effectively reduced to a single image line per color channel, the column average profile. This causes spikes to form at the positions of the failed printing nozzles in the column average profile, where the corresponding color values are missing. The spikes clearly stand out among the neighboring color values in the remaining image line. Then a median filter is applied to this color value progression in the column average profile to filter out all spikes and the other image noise. This median-filtered graph or waveform without spikes and noise is then subtracted from the original column average profile. The result is a resultant profile that only includes the spikes and the noise. The actual color values that in terms of the missing nozzles only represent an unnecessary offset value in the column average profile are thus eliminated. The next step is to set a threshold that defines a missing nozzle when exceeded. All values below this threshold generally only represent normal image noise and are thus filtered out. The higher the threshold, the less sensitive the missing nozzle detection. The lower the threshold, the more sensitive it is, yet the higher the risk of false positives that would cause image noise to be considered missing nozzles. In the remaining column average profile, every spike over the present print image width marks a missing nozzle. Based on this knowledge, missing nozzles compensation may be carried out in accordance with a prior art compensation process. A preferred compensation process is to compensate for the missing nozzles using functioning neighboring nozzles.

Advantageous and thus preferred further developments of the method will become apparent from the associated dependent claims and from the description together with the associated drawings.

Another preferred development in this context is that the current print image is printed with only one of the used process colors and a color separation out of RGB that colorimetrically fits the printed process color or a gray value image out of RGB is selected and the method is carried out individually for every process color. In a case in which the method of the invention is used for a multicolor print, there are various application approaches. One of these approaches is to carry out the method individually for every process color. In this process, a print image is printed for every process color that is used. Then a color separation out of RGB that colorimetrically fits the printed process color or the entire gray value image out of RGB is selected from the redigitized print image and the detection process of the invention is carried out for the process color that has just been printed. The method of the invention is accordingly repeated in the same way for the other process colors that are used.

In accordance with a further preferred development of the method of the invention, the current print image is every print image printed in the course of a printing operation using all process colors and inspected in a continuous image inspection process and a gray value image is selected out of RGB from the digitized print image wherein the relevant color of the failed printing nozzle results from the combination of the RGB color channels concerned. The second approach is to print the current print image with all process colors in use. In this case, the complete gray value image logically needs to be selected from the redigitized print image instead of a single color separation. The color of the failed nozzle may then be determined from the combination of the RGB color channels concerned.

In this context, an advantage of the method of the invention is that only the print nozzles that are actually visible in the printed image are corrected. In addition, the method is more sensitive because the contrast is very high. In addition to completely failed printing nozzles, it is possible to detect interrupted lines, i.e. printing nozzles that fail temporarily. In this case, the spike in the corresponding area of the column average profile is slightly smaller but may still be detected as long as it exceeds the threshold. v In accordance with the invention, the object may alternatively be attained by a method for detecting and compensating for failed printing nozzles in an inkjet printing machine by using a computer, comprising the steps of printing a current print image, recording the printed print image by using an image sensor and digitizing the recorded print image by using the computer, adding the color values of every column over the entire print image height and dividing the added color values by the number of pixels to obtain a column profile, subtracting a pre-created column profile of a defect-free reference image of the same print image from the original column profile to calculate a differential column profile, setting a maximum value threshold that defines a failed printing nozzle when exceeded, applying that maximum value threshold to the differential column profile to obtain a column profile in which every maximum marks a failed printing nozzle, and compensating for the marked printing nozzles in a subsequent printing operation. The disadvantage of the former method of the invention described above is that a pre-defined reference needs to be printed and subsequently digitized.

Another method of the invention for solving the problem of detecting missing nozzles will be presented below. This method likewise includes the creation of a column average profile over the entire print image width, but it is not a reference to be determined first in the form of a median-filtered column average profile progression that is subtracted from the generated column average profile but a previously created column average profile of a defect-free reference image of the same print image. An advantage of this process is that it is much easier to implement in mathematical terms because it only includes a simple subtraction of the two and includes target column average profiles. The further steps of the invention in terms of setting the thresholds and compensating for the detected missing nozzles correspond to the first method of the invention.

A further preferred development in this context is that the defect-free reference image of the same print image is a printed, recorded, and digitized print image that has been declared defect-free by a user or is created by the computer directly from the prepress data of the current print job. The defect-free reference image may be a printed print image that has been printed, recorded by a camera, redigitized, and declared defect-free by a user, or a purely digital print image the computer creates directly from the prepress data of the current print job. In this context, great advantages of accessing the digital prepress image are that on one hand, an absolutely defect-free image is available as a reference and on the other hand, the entire computational effort may be carried out even before the printing operation starts. However, it is also conceivable to simply automatically use an image that has been compensated for missing nozzles in accordance with the method of the invention as a defect-free reference image.

An added preferred development in this context is that the computer analyzes the prepress image to determine image areas that are covered to an optimum degree by respective process colors to be inspected and that the column profile is created only for this area and that the subtraction of the previously created column profile of the defect-free reference image only occurs in the determined image areas. Since logically a missing nozzle in a specific process color will have a negative effect especially in image areas that are mainly covered by the process color of the missing nozzle and only to a lesser extent in areas where the process color of the missing nozzle only contributes partly to the print image or not at all, it is advantageous to create the column average profile only for those areas that are covered to an optimum degree by the process color to be examined. The subtraction of the previously created column average profile of the defect-free reference image is accordingly carried out only in the determined image areas that are covered to an optimum extent by the respective process color to be examined. These image areas are determined by a computer-assisted analysis of the prepress print image.

An additional preferred development in this context is that the computer transforms the prepress image by using a color space transformation into the camera color space with the aid of an ICC profile and that subsequently the column profile of the transformed prepress image is used in the subtraction from the original column profile. Since the exclusively digital prepress image and the printed print image redigitized by the camera belong to different color spaces, it is advantageous to transform the digital prepress image into the camera color space by using a color space transformation with the aid of an ICC profile before carrying out the subtraction. Conversely, it is possible to transform the redigitized print image into the prepress color space, but since every transformation increases existing noise and the purely digital prepress image is logically less prone or not at all prone to noise, the transformation of the prepress image into the camera color space is preferred. The subtraction of the two column average profiles of the two print images is much more efficient if is carried out in the same color space.

Another preferred development in this context is that the color separation R or G or B of the transformed prepress image that is used is the one in which the color to be evaluated has the greatest contrast relative to the selected color separation. For the red channel, for instance, this is cyan, for the green channel, it is magenta, and for the blue channel, it is yellow. The evaluation is more efficient if of the print image redigitized by the RGB camera, that color separation that has the highest contrast relative to the color to be evaluated is used for the respective color to be evaluated. For all other colors, the color channel to be used is determined by the maximum gray value difference between the color and the white of the paper.

A further preferred development in this context is that the maximum value threshold that defines a failed printing nozzle when exceeded is a fixed threshold or corresponds to the multiplied average or to the multiplied standard deviation. The defined threshold that defines a missing nozzle among the existing spikes may be a fixed threshold, may correspond to the multiplied average, or to the multiplied standard deviation. In this context, multiplied means that the average over the entire column average profile line is determined and multiplied n times, for instance twice or three times, to be used as the threshold. The same applies to the standard deviation. An advantage over a purely fixed threshold is that they are geared to the respective color values that actually occur in the current print image and therefore act much more adaptively.

A concomitant preferred development in this context is that to determine the location of the detected failed printing nozzles, individual printing nozzles at a defined distance are specifically deactivated before or after every detection process and the position thereof is determined by the detection process. Since it is not always known to which failed printing nozzle a corresponding spike in the column average profile belongs, and since it is thus not always possible to allocate detected missing nozzles to a specific printing nozzle, the following process is proposed in accordance with the invention. Before and after every detection process for a specific print image, but before the compensation, individual printing nozzles at a defined distance from one another are intentionally deactivated. Having deactivated these printing nozzles, the detection method of the invention is carried out. The column average profile that has been generated in this way logically will include spikes for the artificially created missing nozzles at the same defined distance of the printing nozzles deactivated in a controlled way. The known location information of the specifically deactivated printing nozzles and the column average profile spikes that are easily allocatable due to the defined distance may then be used to determine the exact position and location of the other, real missing nozzles.

Other features which are considered as characteristic for the invention are set forth in the appended claims.

Although the invention is illustrated and described herein as embodied in a method for detecting and compensating for failed printing nozzles in an inkjet printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
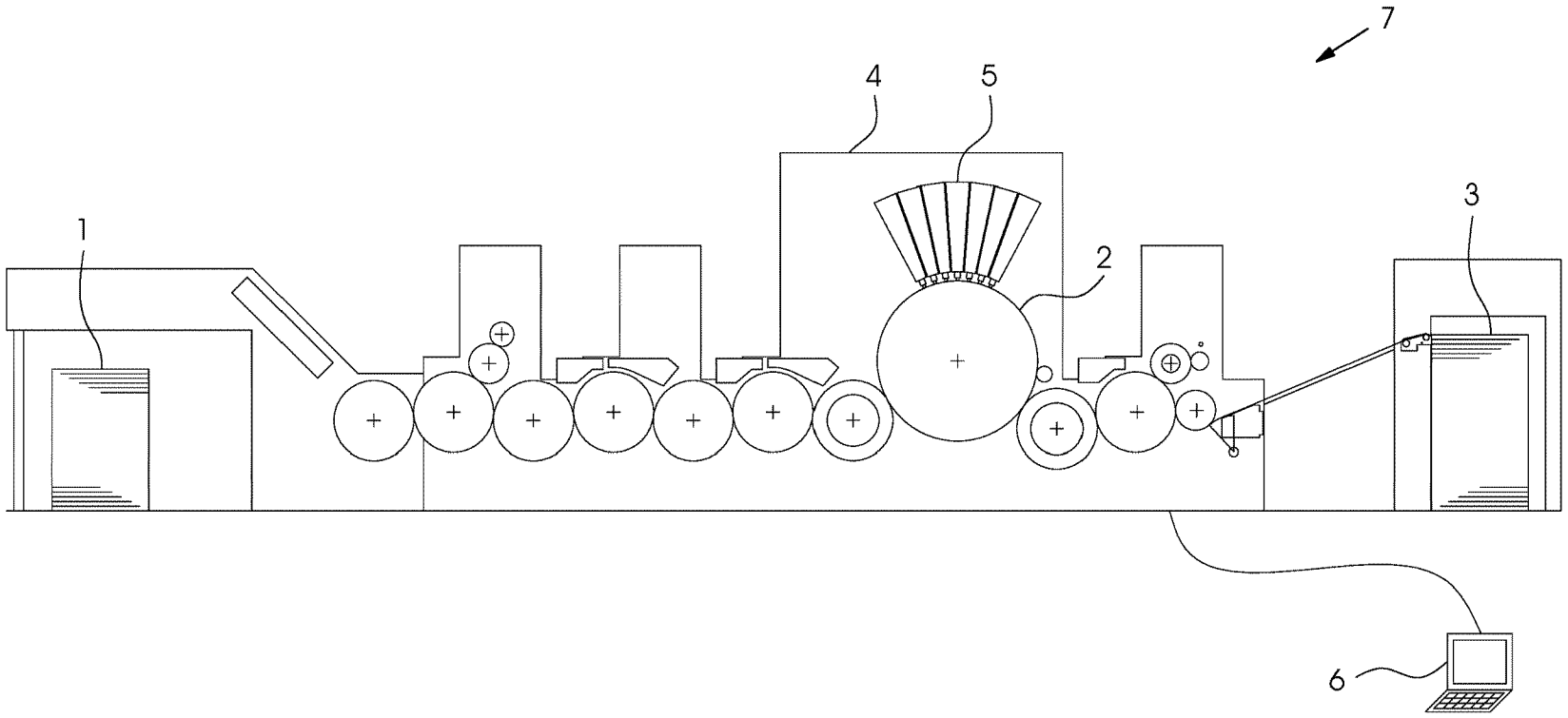
FIG. 1 is a diagrammatic, longitudinal-sectional view of an example of the structure of a sheet-fed inkjet printing machine.
Figure 2:
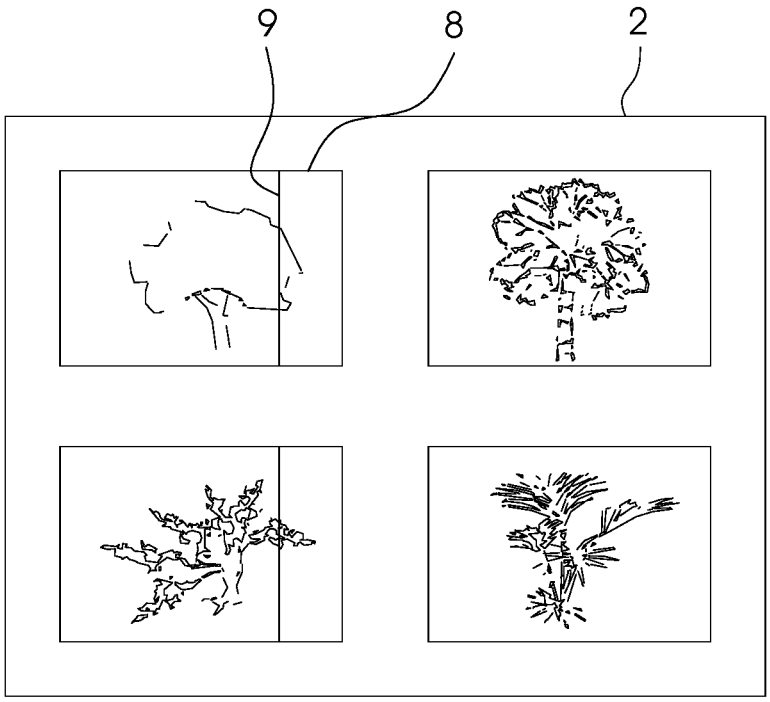
FIG. 2 is a top-plan view of a substrate illustrating an example of a white line caused by a missing nozzle.

Referring now in detail to the figures of the drawings, in which mutually corresponding elements have the same reference symbols, and first, particularly, to FIG. 1 thereof, there is seen an inkjet printing machine 7, which is in the field of application of the preferred exemplary embodiment. FIG. 1 shows an example of the fundamental structure of such a machine 7, including a feeder 1 for feeding a printing substrate 2 to a printing unit 4, where it receives an image printed by inkjet print heads 5, as well as a delivery 3. The illustrated machine is a sheet-fed inkjet printing machine 7 controlled by a control unit or computer 6. While this printing machine 7 is in operation, individual printing nozzles in the print heads 5 in the printing unit 4 may fail as described above. Such a failure results in white lines 9 or, in the case of multicolor printing, in distorted color values. An example of such a white line 9 in an entire printed image 8 is shown in FIG. 2.

Figure 7:
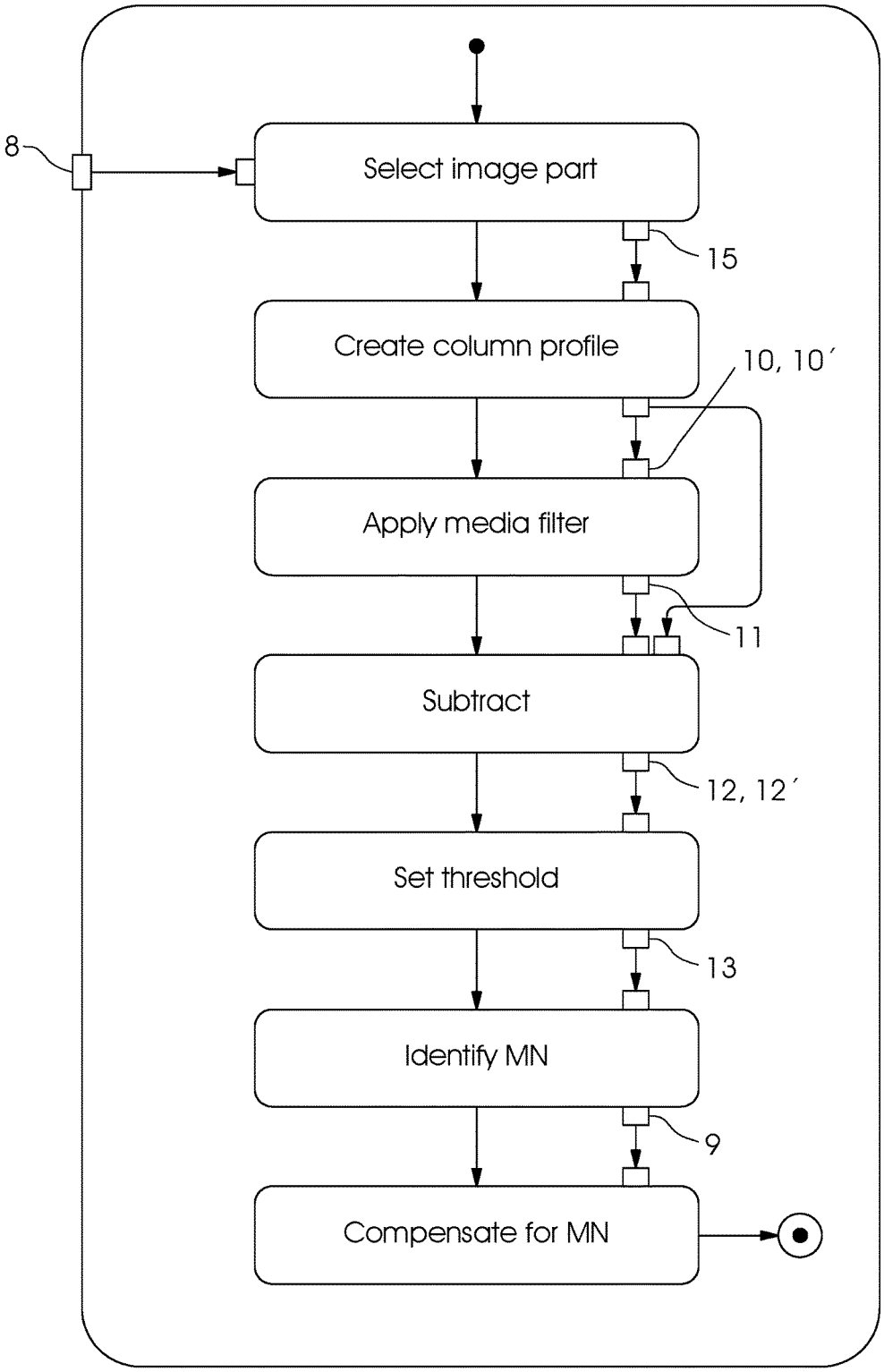
FIG. 7 is a flow chart of the method of the invention.

A flow chart of the method of the invention is illustrated in FIG. 7. The missing nozzle detection process described below makes use of the knowledge that missing nozzles cause white lines 9 or distorted color values and will firstly be described for the simple case of a single process color before the more general case of multicolor printing is discussed.

Figure 3:
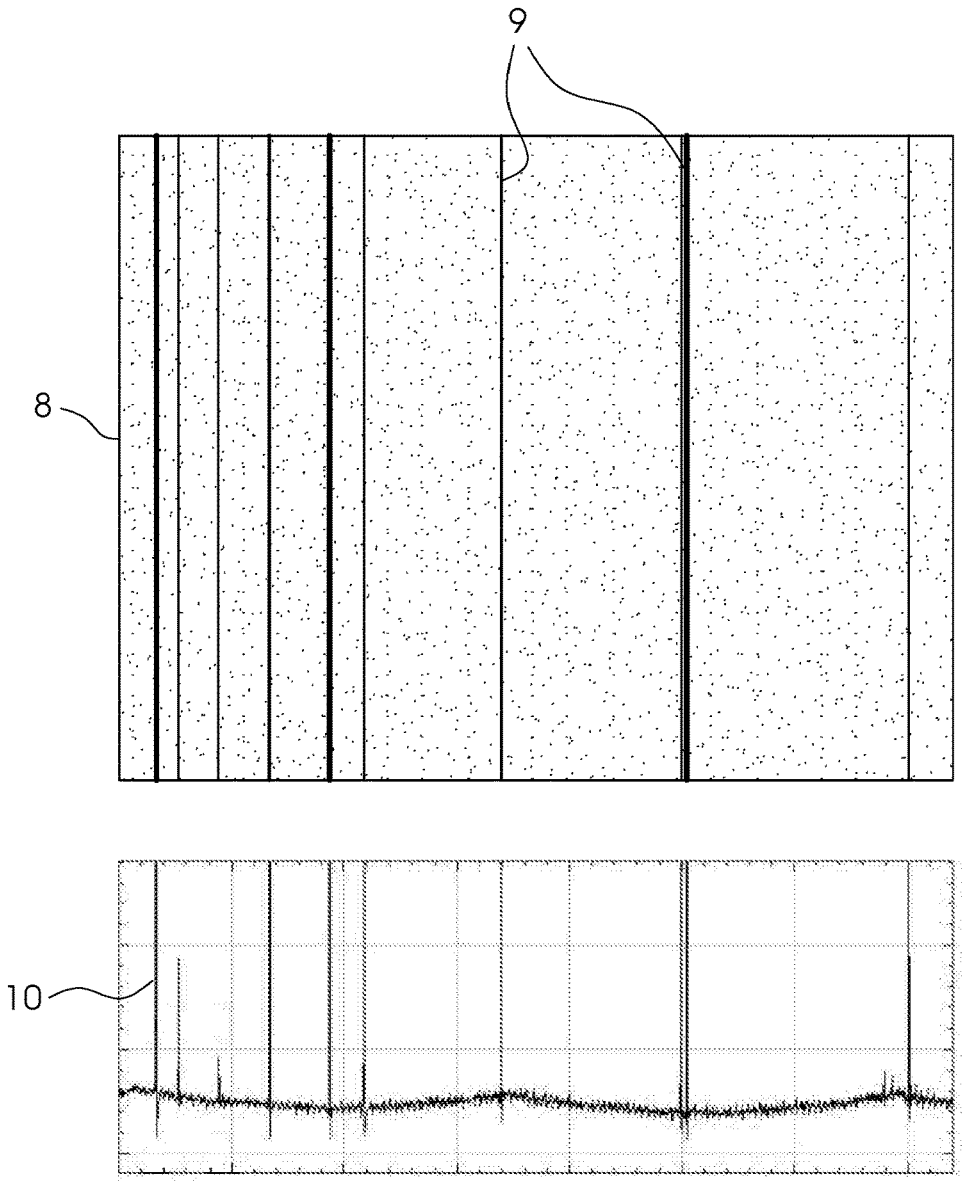
FIG. 3 is a top-plan view illustrating an example of a column profile and an associated printed image.

In the camera image of the original print image 8, e.g. a solid bar across the entire printing width, a column total of the gray values in the printing direction is calculated, in an extreme case reducing the entire image or image part to a single image line per color channel. In general, this is done over the entire printing width. For this purpose, the total of the gray values is normalized to the number of column pixels, in turn resulting in a gray value between 0 and 255. As a result, spikes that clearly stand out from their vicinity form at the locations of the failed printing nozzles. This is best illustrated in the example of the solid black bar in the green channel of the print image 8 as shown in FIG. 3. In this case, it can also be seen that adding up over many pixels drastically reduces the camera and print noise, causing the missing nozzle signal to stand out even more clearly.

There are a number of advantages to this method:

Only the printing nozzles that are actually visible in the image are corrected. The method is more sensitive than the known prior art methods because the contrast is very high. In addition, apart from completely failed printing nozzles, it is also possible to detect interrupted lines, i.e. nozzles that fail temporarily and nozzles that deviate only very little from their ideal position, because every printing nozzle is represented in a much larger area at the same printing length.

A disadvantage of this method is that the position of the missing nozzles may be detected at an accuracy of a pixel at the maximum, although it may be much more than a pixel in the case of defects in the optical representation. Since the resolution of the camera is in general lower than that of the printer by a factor 2 to 4, the exact location of the missing nozzle needs to be determined in a further process. This may be done by a combination of this method with the specific printing nozzle check patterns known from the prior art and including the horizontal rows of periodically vertically printed equidistant lines.

Yet in accordance with the invention a much better method is to generate the location calibration required to determine the exact location by using the same method of the invention. For this purpose, a pattern including artificial missing nozzles is printed before or after every search for missing nozzles but before any missing nozzle compensation. This is done by intentionally switching off individual nozzles at a defined distance, e.g. every hundredth or thousandth nozzle. Then the method of the invention is used to determine the positions of the artificial missing nozzles. The result is a fixed and unequivocal local correlation between camera pixel and printing nozzle, allowing the actual missing nozzles to be accurately allocated and corrected.

Figure 4:
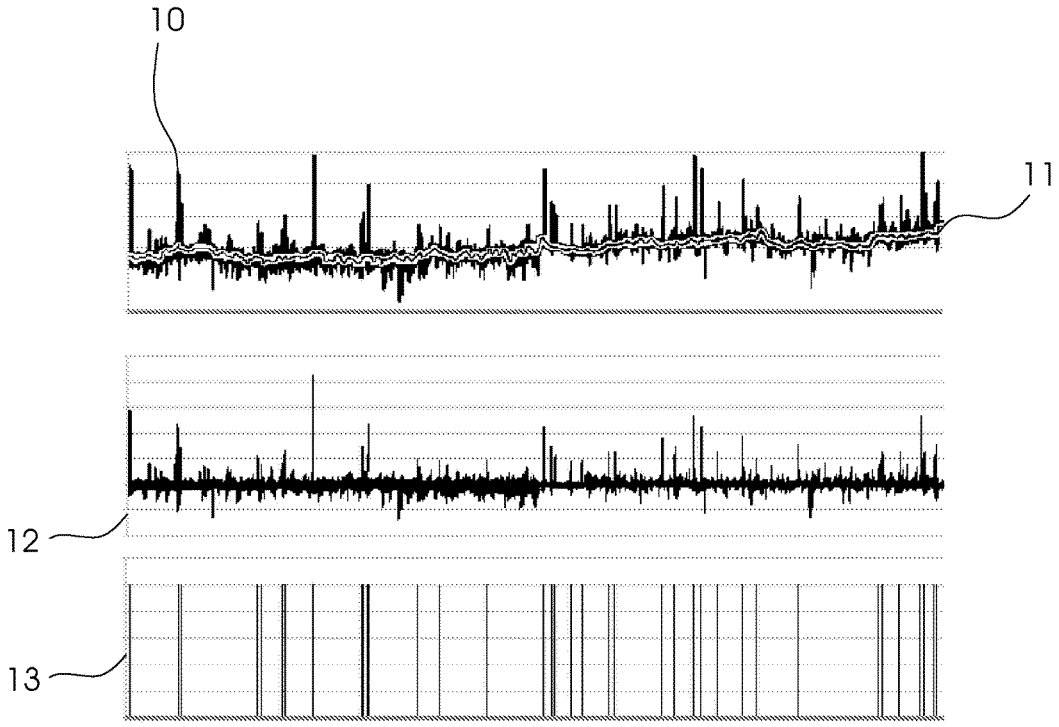
FIG. 4 is a diagram illustrating the processing of a column profile for missing nozzle detection.

The resultant missing nozzle detection method of the invention includes the following steps:

selecting a color separation from (R/G/B) or generating a gray value image from R+G+B, potentially including weighting;

adding up the gray values in every column of the print image over the entire structural height and dividing by the number of pixels of the column to obtain a column average profile 10 of a sheet (see FIG. 4, first image, waveform 10), In this case it is clearly visible how the missing nozzles stand out as spikes;

applying a median filter to this gray value progression to filter out the spikes and the noise to obtain a median-filtered column image profile 11 (see FIG. 4, first image, waveform 11);

subtracting the resultant graph from the original graph of the column average profile to obtain a subtracted column image profile 12 (see FIG. 4, second image, waveform 12);

setting a threshold (fixed or n*average or n*standard deviation) that defines a missing nozzle when exceeded→this threshold allows the sensitivity to be controlled to obtain a threshold-filtered column image profile 13 (see FIG. 4, third image, waveform 13).

The described method is applied during the production printing process. Every recorded image is reduced to a line in the way described above and the data are continuously monitored. As soon as changes occur, they are analyzed. If the changes are spikes that relate to a significant amplitude change in only one pixel, they refer to a failed missing nozzle. The color in question may be determined from the combination of the RGB color channels concerned.

Since the described method detects only missing nozzles that occur in the subsequent printing operation, starting from a reference defined in advance, a further, preferred modus operandi in accordance with the invention will be described.

A reference image that has been reduced to a line and has been determined by using a previously defined OK image is subtracted from the current actual image reduced to a line. The OK image is either checked by the user and released as such or is based on an image that has been corrected for missing nozzles and has been found to be without defect using the pattern evaluation method for every single nozzle as described above.

Another advantage of this method is that it is more easily implemented in mathematical terms because it is a simple subtraction of the actual line created in this way and the target line.

An optimum evaluation ought to detect and correct the missing nozzles without any artificially printed structures or interruption of the printing process. This may be done by the further preferred modus operandi of the invention described below. The magnitude of such a peak in an image reduced to a line as created by a missing nozzle above all depends on the size of the ink-covered area of the summed-up image column in proportion to the uncovered paper area. Thus, the method may be further enhanced by an advance analysis of the CMYK prepress image to determine for every color the region that is covered by the respective process color in an optimum way and by adding up the respective column total in the prepress image and print image only over the height of this region.

Figure 5:
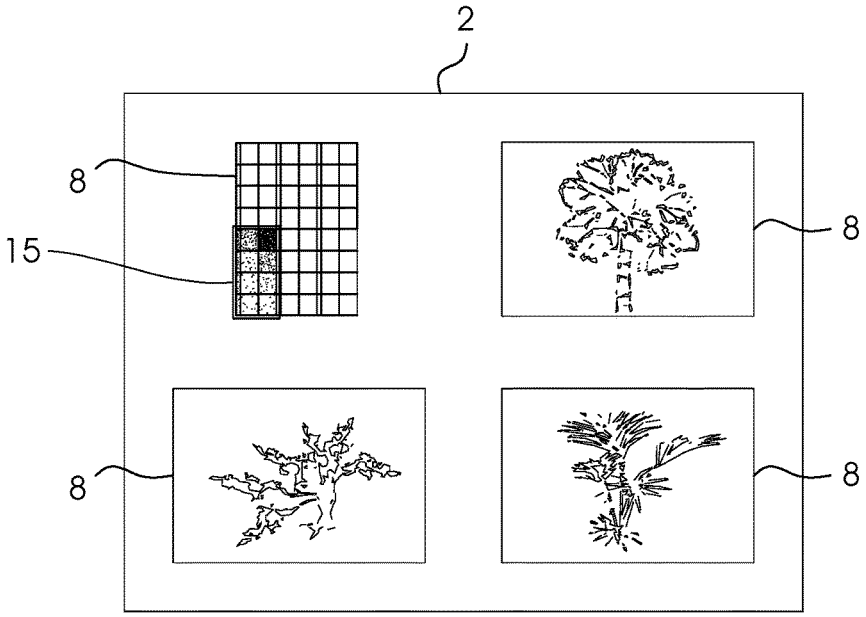
FIG. 5 is a top-plan view of a substrate illustrating an original image for establishing a column profile for a specific process color.
Figure 6:
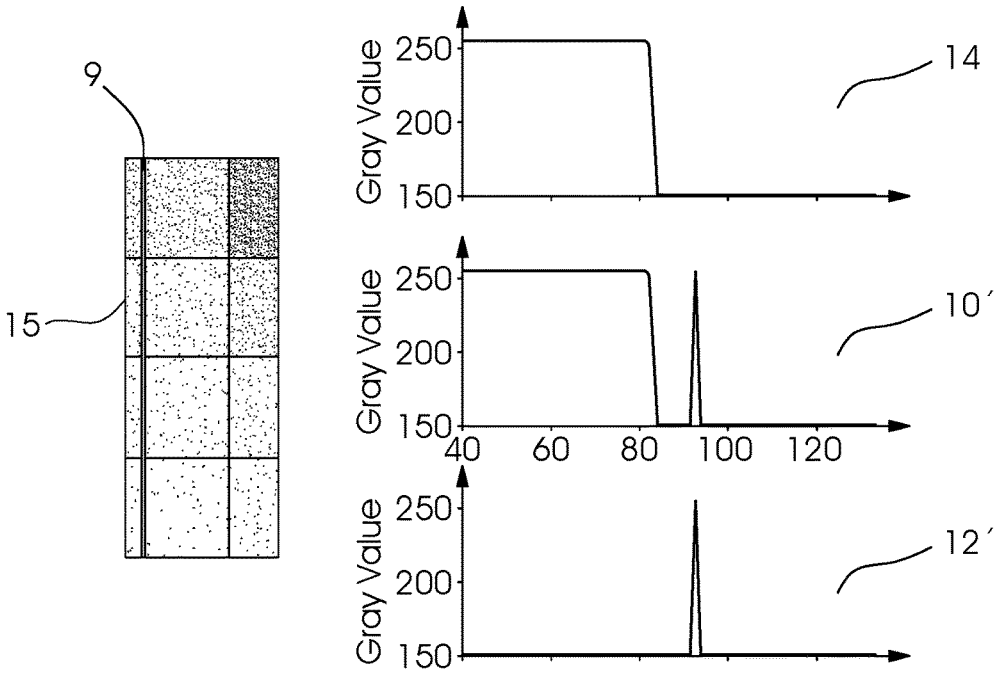
FIG. 6 is a diagram illustrating a column average profile of a selected area of the original image for a specific process color.

An example is the selected image area 15 indicated by way of example in FIG. 5 in the form of a cyan structure out of the printed image 8, which is taken from the first image of FIG. 5 and is shown separately again in the first image of FIG. 6. In FIG. 6, the selected area 15 is contrasted with the column average profile 10' created therefrom. Now if we create the column average profile 10' only for this region, the corresponding peak will be greater by a multiple in relation to the ambient noise as can be seen in the second to fourth images in FIG. 6. The second image of FIG. 6 represents the column average profile 14 of the defect-free reference image, the third image represents the column average profile 10' of the selected image part 15, and the fourth image represents the resultant subtracted column average profile 12'.

In accordance with a further preferred embodiment of the method of the invention, for every single color separation, the pixels that include the color to be evaluated are determined and recorded in the BCMY prepress image, which has been expanded to 5/6/7 or 8 colors in a corresponding way. Only the prepress image pixels that contain this color contribute to the column total for the reference image. The same pixels are added up in the RGB image of the camera. This considerably increases the signal dynamics.

A further preferred improvement of the results in accordance with the invention is achieved in that the prepress image, which is normally represented in the CMYK color separations or in another standardized color space such as eciRGB or Lab, is previously subjected to a color space transformation into the camera color space with the aid of an ICC profile. In this case, an inverse process, i.e. converting the camera image to eciRGB, would be possible, but since every transformation increases existing noise, the former process is preferred because, in contrast to the camera image, the prepress image is noise-free.

The color separation R or G or B that is used is preferably the one in which the color to be evaluated has the greatest contrast, i.e. the red channel for cyan, the green channel for magenta, and the blue channel for yellow. For all other colors, this channel is determined by the maximum gray value difference relative to the white of the paper. Alternatively, a weighted gray color color space may be used, which would result in reduced signal dynamics but would reduce the considerable amount of data to a third.

eciRGB→ICC_In (eciRGB)→ICC_Out(ProfileCamera) →RGB_Cam

A considerable advantage of accessing the prepress image is that on one hand, an absolutely defect-free reference image is available and on the other hand, the entire computational effort may be completed before the beginning of the printing operation.

The invention claimed is:

1. A method for detecting and compensating for failed printing nozzles in an inkjet printing machine by using a computer, the method comprising the following steps:

printing a current print image;

recording the printed print image by using an image sensor and digitizing the recorded print image by using the computer;

adding digitized color values of the recorded print image of every column over an entire print image height and dividing the added color values by a number of column pixels to obtain a column profile;

subtracting an optimized column profile without failed printing nozzles from an original column profile to provide a differential column profile;

setting a maximum value threshold defining a failed printing nozzle when exceeded;

applying the maximum value threshold to the differential column profile to obtain a resultant column profile having maximums each marking a failed printing nozzle; and compensating for the marked printing nozzles in a subsequent printing operation.

2. The method according to claim 1, which further comprises creating the optimized column profile without failed print nozzles by applying a median filter to the column profile, causing occurring maximum values and noise in the column profile to be filtered out.

3. The method according to claim 1, which further comprises generating the optimized column profile without failed print nozzles by a previously created defect-free reference image column profile of the same print image.

4. The method according to claim 3, which further comprises providing the defect-free reference image of the same print image as a printed, recorded and digitized print image having been declared defect-free by a user or created by the computer directly from prepress data of a current print job.

5. The method according to claim 3, which further comprises using the computer to analyze the prepress image to determine image areas being covered to an optimum degree by respective process colors to be inspected, creating the column profile only for this area, and carrying out the subtraction of the previously created column profile of the defect-free reference image only in the determined image areas.

6. The method according to claim 3, which further comprises using the computer to transform a prepress image into a camera color space by using a color space transformation aided by an ICC profile, and subsequently using the column profile of the transformed prepress image for the subtraction from the original column profile.

7. The method according to claim 3, which further comprises using a respective color separation R or G or B of a prepress image in which a color to be evaluated has a greatest contrast relative to a selected color separation.

8. The method according to claim 1, which further comprises printing a current print image with only one used process color, selecting from the digitized print image a color separation out of RGB that colorimetrically fits the printed process color or a gray value image out of RGB, and carrying out the method individually for every process color.

9. The method according to claim 1, which further comprises providing the current print image as every print image printed in a course of a printing operation using all process colors and being examined in a continuous image inspection process, and selecting from the digitized print image a gray value image out of RGB from the digitized print image, the relevant color of the failed printing nozzle resulting from a combination of RGB color channels in question.

10. The method according to claim 1, which further comprises providing the maximum value threshold defining a failed printing nozzle when exceeded as a fixed threshold or corresponding to a multiplied average or to a multiplied standard deviation.

11. The method according to claim 1, which further comprises defining a location of the detected failed printing nozzles, before or after every detection process, by specifically deactivating individual printing nozzles at a defined distance and determining a position thereof in the detection process.

* * * * *